US005192148A

United States Patent [19]

Suematsu et al.

[11] Patent Number: 5,192,148

[45] Date of Patent: Mar. 9, 1993

[54] DOT LINE PRINTER HAVING IMPROVED COMB YOKE

[75] Inventors: Shigenori Suematsu; Yoshikane Matsumoto; Shinichi Sakamoto; Hirotaka Kobayashi, all of Katsuta, Japan

[73] Assignee: Hitachi Koki Co., Ltd., Tokyo, Japan

[21] Appl. No.: 704,149

[22] Filed: May 22, 1991

[30] Foreign Application Priority Data

May 25, 1990 [JP] Japan ..... 2-135752

[51] Int. Cl.[5] ..... B41J 9/38

[52] U.S. Cl. ..... 400/157.2; 101/93.29

[58] Field of Search ..... 400/124, 157.2, 157.3; 101/93.04, 93.29

[56] References Cited

U.S. PATENT DOCUMENTS

| | | | |
|---|---|---|---|
| 4,258,623 | 3/1981 | Barrus et al. | 101/93.04 |
| 4,674,897 | 6/1987 | West et al. | 400/157.2 |
| 4,682,903 | 7/1987 | Agata | 101/93.04 |
| 4,833,980 | 5/1989 | Bringhurst | 400/157.2 |
| 4,913,569 | 4/1990 | Koyama et al. | 400/124 |
| 4,995,744 | 2/1991 | Goldowsky et al. | 400/157.2 |
| 5,046,871 | 9/1991 | Saitou et al. | 400/157.2 |

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

A hammer bank assembly including a hammer base, a plurality of leaf spring type printing hammers, permanent magnets, a comb yoke and electromagnetic coils. The comb yoke has a base portion positioned on the permanent magnets and police portions secured by the base portion and extending from the base portion toward the rear faces of the printing hammers. The pole portions are made of a material capable of providing highly saturated magnetic flux density, and the base portion comprising a plurality of metal plates laminated together and containing another material which provides low saturated magnetic flux density.

16 Claims, 2 Drawing Sheets

DOT LINE PRINTER HAVING IMPROVED COMB YOKE

BACKGROUND OF THE INVENTION

The present invention relates to a dot line printer, and more particularly, to a type thereof having an improved comb yoke.

A dot line printer generally provides a hammer bank which secures spring charged printing hammers arranged in side by side in a shuttling direction. During reciprocal movements of the hammer bank, the print hammers are selectively operated to provide a dot impression image on a printing sheet. Incidentally, throughout the specification, the term "shuttling direction" is used to indicate a transverse direction of a printing sheet or reciprocating or shuttling direction of a hammer bank which includes a printing hammer assembly, and the term "line to line direction" indicates a feeding direction of the printing sheet.

One example of a conventional dot line printer is shown in FIG. 1. The printer includes a hammer bank 3 which secures printing hammers (not shown in FIG. 1). The hammer bank 3 is reciprocally movable by a shuttle motor 1 through a cam member 2 in the shuttling direction X. Upon a single rotation of the shuttle motor 1, one reciprocation of the hammer bank 1 is provided. The cam 2 is coupled to a cam shaft to which an encoder 4 is connected. The encoder 4 is formed with a plurality of slits indicative of a reciprocating position of the hammer bank 3. Further, a sensor 5 is positioned in a vicinity of the encoder 4 so as to detect the slit. A platen 6 extends in the shuttling direction X, and an endless ink ribbon 7 also extends in the shuttling direction at a position between the hammer bank 3 and the platen 6. Furthermore, a sheet feed motor 10 is provided, and a pin tractor 9 drivingly connected to the sheet feed motor 10 is also provided for feeding a printing sheet 8 in the line to line direction as indicated by an arrow Y. The printing sheet 8 is adapted to pass through a space defined between the ink ribbon 7 and the platen 6. Upon selective actuation of the printing hammers, the hammers are moved toward the platen 6, so that the intermediary ink ribbon is selectively depressed by the printing hammers to provide an ink image on the printing sheet 8.

FIG. 2 shows a conventional spring charged type hammer bank assembly 3. The assembly includes a hammer base 14 extending in the shuttling direction and having a front face, and a plurality of leaf spring type printing hammers arranged side by side in the shuttling direction. The printing hammers comprise hammer springs 11. The hammer springs 11 have free ends provided with printing pins 12, intermediate portions provided with plungers 13 formed of magnetic material, and a base end portion. Further, a front yoke 15 is provided in front of the hammer springs 11, and the base end of the hammer springs 11 and the front yoke 15 are fixed to the front face of the hammer base 14 by screws 16. A comb yoke 18' (FIG. 3) also extends in the shuttling direction and at a position behind the hammer springs 11, and a front portion of the comb yoke 18' defines pole portions 18*a* (FIG. 3). A permanent magnet 17 is interposed between the comb yoke 18' and the hammer base 14 for allowing the free end portion of the hammer springs 11 to be attracted to the pole portions 18*a* in order to provide non printing position of the hammer springs 11. Further, electromagnetic coils 19 are wound over the pole portions for selectively releasing the free end portions of the hammer springs 11 from the associating pole portions and for directing the free end portions toward the printing sheet in order to perform dot line printing.

In order to perform high speed dot line printing, the printing hammers must be arranged at high density. However, with the above described spring-charged type printing hammers, several deficiencies may result for the high speed dot line printing. More specifically, as shown in FIG. 3, the comb yoke 18' has a plurality of pole portions 18*a* and a base portion 18*b* joining together the pole portions. The pole and the base portions are integrally provided and the integral comb yoke 18' is formed of a magnetic material such as silicon steel. The numbers of the pole portions is equal to or more than the numbers of the printing hammers, and the pole portions are arranged side by side at a constant pitch P1 corresponding to an array of the printing hammers.

The pitch P1 of the pole portions 18*a* must be as small as possible in order to provide the high density arrangement of the hammers. Here, in order to attract the printing hammer to the pole portion, sufficient amount of magnetic flux must be required. Therefore, a material capable of providing highly saturated magnetic flux density must be used as a material of the comb yoke. In this connection, Permendur has been used as the material. Permendur is a magnetic alloy which is composed of equal parts of iron and cobalt and has an extremely high permeability when saturated. However, Permendur is an extremely expensive material, e.g., ten times as expensive as silicon steel. Accordingly, the resultant comb yoke becomes expensive.

Further, in a high density arrangement of the printing hammers for the purpose of high speed printing, heat generation amount per unit area becomes large at the printing hammer portion. Accordingly, insufficient cooling to the hammer bank results. Moreover, large electrical power consumption results in the high speed printing.

SUMMARY OF THE INVENTION

It is therefore, an object of the present invention to provide an improved hammer bank assembly of a dot line printer in which a comb yoke can be provided at low cost, and electrical power consumption for driving the printing hammers and heat generation amount at a hammer bank can be reduced.

This and other objects of the invention are attained by providing a hammer bank assembly of a dot line printer for creating dot impression images on a printing sheet in the reciprocal movement of the hammer bank assembly and feeding the printing sheet in a line to line direction, the hammer bank assembly having (a) a hammer base provided for reciprocal movement in a shuttling direction, the hammer base having a front face, (b) a plurality of leaf spring type printing hammers held on the front face of the hammer base and arranged side by side at a predetermined pitch in the shuttling direction, the printing hammers having front faces in confrontation with the printing sheet and rear faces, (c) permanent magnets mounted on the hammer base for attracting the printing hammers away from the printing sheet, (d) a comb yoke mounted on the hammer base, the comb yoke having a base portion positioned on the permanent magnets and pole portions secured by the base portion and extending from the base portion toward the rear faces of the printing hammers, the rear faces of the printing hammers being attracted toward the pole portions by the permanent magnets, the pole portions being made of a first material capable of providing highly saturated magnetic flux density, and the base portion comprising a plurality of metal plates laminated together and containing a second material which provides low saturated magnetic flux density, and (e) electromagnetic coils wound over the pole portions for releasing the attracted printing hammers from the pole portions for dot impressions.

Although the pole portions undergo restriction in terms of cross-sectional area of magnetic path due to the winding of the electromagnetic coils, these deficiencies can be compensated by the employment of the first material. On the other hand, the base portion which provides relatively large cross-sectional area for the magnetic path employs the second material which is inexpensive in comparison with the first material. Therefore, the resultant comb yoke can be produced at low cost. Further, because of the employment of the laminating arrangement at the base portion, eddy current loss can be reduced. Thus, electrical power consumption for driving the printing hammer can be reduced and heat generation at the hammer bank can also be reduced.

DETAILED DESCRIPTION OF THE PREFERRED EMBODIMENTS

Figure 1:
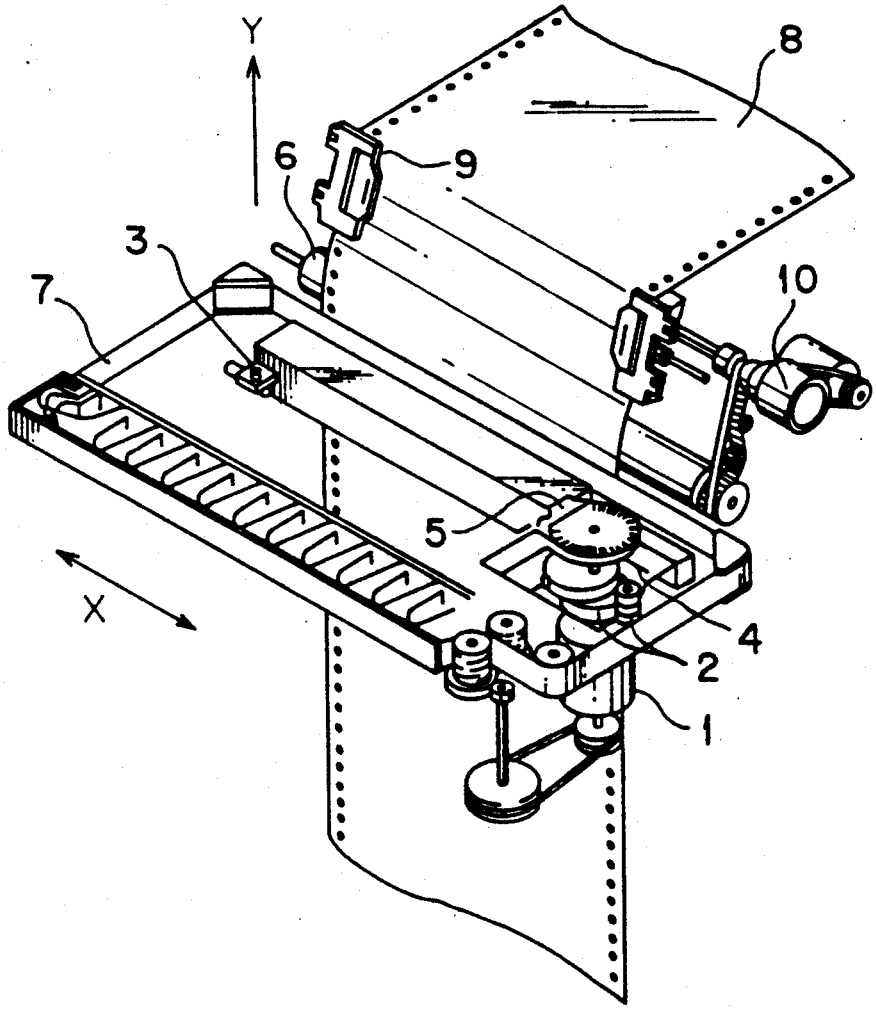
FIG. 1 PRIOR ART
FIG. 1 is a perspective view showing an overall arrangement of a conventional dot line printer.
Figure 2:
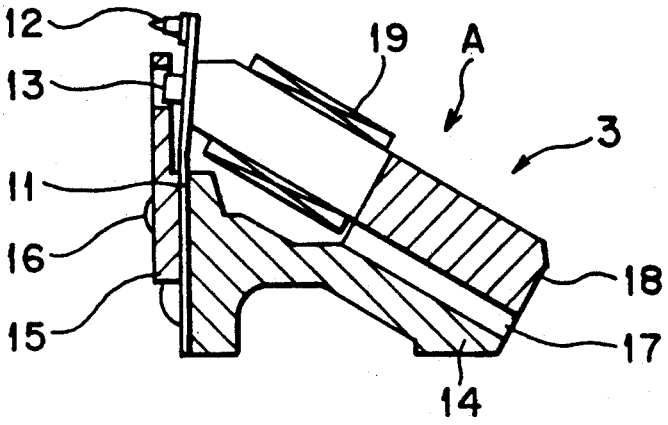
FIG. 2 PRIOR ART
FIG. 2 is a cross-sectional view showing a spring charged type printing hammer assembly according to a conventional dot line printer.
Figure 3:
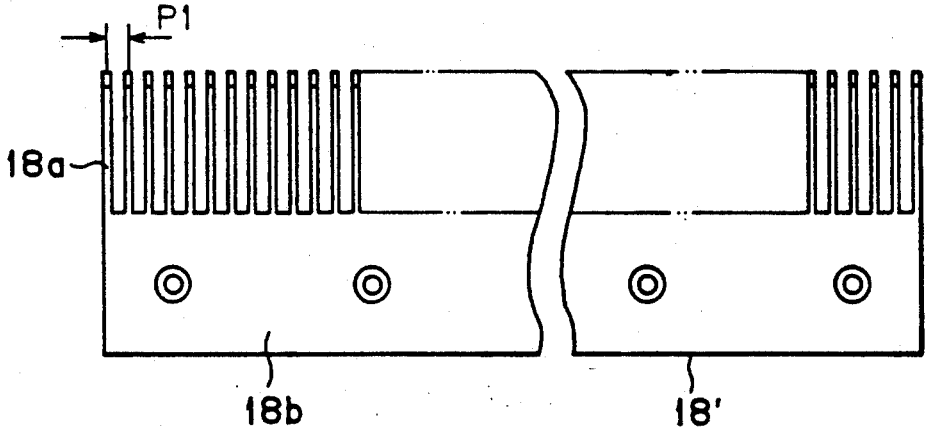
FIG. 3 PRIOR ART
FIG. 3 is a plan view showing a conventional comb yoke of the conventional spring charged type hammer bank assembly.
Figure 4:
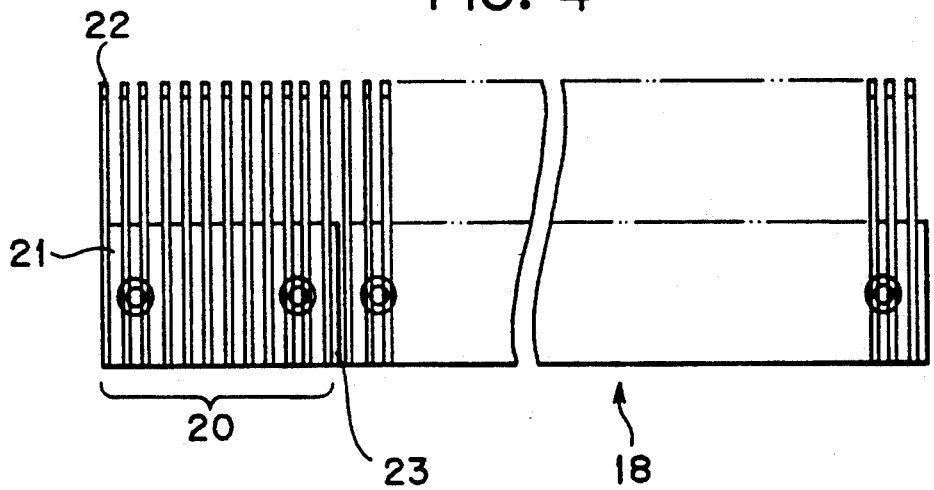
FIG. 4 is a plan view showing a comb yoke used in a hammer bank assembly according to a first embodiment of this invention.

A hammer bank assembly according to a first embodiment of this invention will be described with reference to FIGS. 1, 2, 4 and 5. Basic construction of the hammer bank assembly according to the embodiment is almost similar to that of the conventional arrangement shown in FIG. 2 except the arrangement of a comb yoke 18. FIG. 4 shows the comb yoke 18 as viewed from an arrow A shown in FIG. 2.

Figure 5:
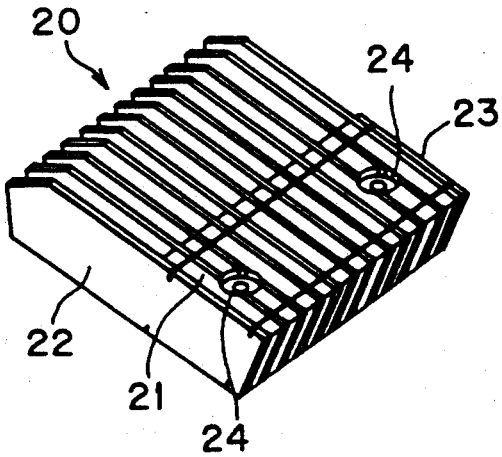
FIG. 5 is a perspective view showing a comb yoke block which constitute the comb yoke according to the first embodiment.
Figure 6:
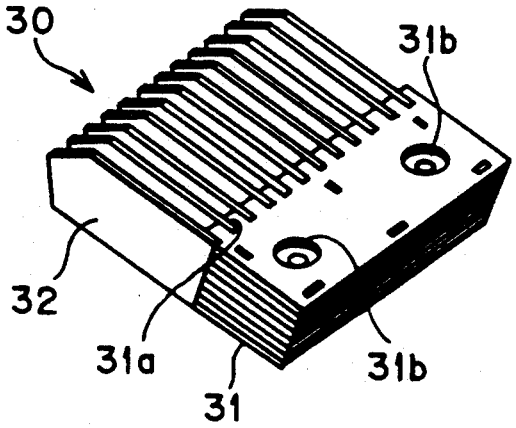
FIG. 6 is a perspective view showing another comb yoke block according to a second embodiment of this invention.

The comb yoke 18 is provided by a combination of a plurality of comb yoke blocks 20 as best shown in FIG. 5. Each of the comb yoke blocks 20 has first yoke pieces 21 (eleven pieces in the exemplified embodiment) formed of silicon steel, second yoke pieces 22 (twelve pieces in the exemplified embodiment) alternately arranged relative to the first yoke pieces 21 and formed of Permendur and a single third yoke piece 23 formed of silicon steel and positioned at one end of the comb yoke block 20. Thus, in-line arrangement is provided in the shutting direction by the combination of the first and second yoke pieces and the final third yoke piece 23. These first through third yoke pieces 21, 22, 23 are joined together by laser-welding, etc., so as to provide a metal piece lamination. The first and the third yoke pieces 21 and 23 can also be made of pure iron or other magnetic material instead of the silicon steel.

The second yoke pieces 22 are made longer than the first yoke pieces 21 so as to provide pole portions over which the electromagnetic coils 19 (FIG. 2) are wound. In other words, spaces are provided between the juxtaposed neighboring second yoke pieces 22 by the interposition of the first yoke piece 21. Even through cross-sectional area of magnetic path is restricted at each of the pole portions due to the necessity for winding the coils 19, this deficiencies is compensated by the employment of Permendur which is a material of highly saturatable magnetic flux density. Therefore, sufficient magnetic flux amount can be provided for the attraction of the hammer springs 11. Holes 24 are formed at the base portion of the comb yoke block 20 for fixing the same to a portion of the hammer bank assembly.

On the other hand, the metal piece lamination of the yoke pieces, i.e., the combination of the first and the third yoke pieces 21 and 23 and base portions of the second yoke pieces 22 is formed of the materials of Permendur (pieces 22) and the silicon steel (pieces 21 and 23). Since the metal piece laminating portion can provide a magnetic path having large cross-sectional area, sufficient magnetic flux density can already be provided even by the employment of the silicon steel which is inexpensive (1/10 as high as the cost of the Permendur). Accordingly, the resultant comb yoke block can be provided at low cost.

A comparative experiment has been conducted to demonstrate the superiority of the comb yoke 18 with respect to electrical power consumption and heat generation amount in comparison with a comb yoke having a construction the same as the above described comb yoke 18 but being integrally made of Permendur only. The test result was that the electrical power consumption attendant to the electromagnetic coil 19 is reduced by 12% in the present embodiment, and the heat generation amount at the hammer bank was reduced by 10 to 12% in the present embodiment. In the latter case, the reduction in heat generation amount was the sum of the reduction in Joule loss due to reduction in coil current and reduction in eddy current loss. More specifically, because of the laminated construction of the comb yoke, eddy current can be reduced, which in turn can supress excessive heat generation (excessive heat generation may be caused by the eddy current generation). This is the "reduction in eddy current loss". Further, because of the reduction in the eddy current, it becomes possible to restrain the electrical current value at low levels for flow through the coil, which in turn reduces Joule losses.

As described above, the comb yoke 18 is provided by the combination of a plurality of comb yoke blocks 20. In other words, twelve pieces of the printing hammers are modularized into one module. This modularization is required so as to prevent the printing hammers from being offset from the tip end positions of the corresponding pole portions of the comb yoke due to the accumulated tolerance attendant to the dimensional inaccuracy or irregularities in thickness of each of the first through third comb yoke pieces when lamination is made.

More specifically, the high speed dot printer generally contains more than hundred numbers of printing hammers 11. Therefore, it is necessary to provide corresponding numbers of pole portions. That is, corresponding numbers of the comb yoke pieces 22 and 21 are also required. If thickness tolerance to each comb yoke piece is in a range of plus/minus 10 micron meters, maximum entire displacement becomes 2 mm (100 pieces$\times 2 \times 10$ $\mu$m). Accordingly, positional alignment between the printing hammers 11 and the tip end faces of the comb yoke is degraded, which in turn render the printer inoperative. To eliminate this drawback, dimensional accuracy to the thickness of the comb yoke pieces must be improved or enhanced. However, this leads to high production costs.

Thus, in the present embodiment, modularized comb yoke blocks are used in order to reduce cumulative dimensional inaccuracy. For example, a thickness of the third yoke piece 23 is made smaller than that of the first yoke pieces 21. When installing the comb yoke blocks 20, this reduced thickness of the third yoke piece 23 can avoid positional interference between the neighboring comb yoke blocks, if at least one of the neighboring blocks has a length in the shutting direction larger than the predetermined length due to the cumulative tolerance in thickness of the respective yoke pieces. Further, the third yoke piece 23 can be dispensed with yet providing similar effect. Non employment of the third comb yoke piece 23 can also lead to simplification in structure of the comb yoke block 20.

A hammer bank assembly according to a second embodiment of this invention will be described in which another example of comb yoke block 30 is used. More specifically, the comb yoke block 30 includes a first set of yoke pieces 32, which correspond to the second yoke pieces 22 of the first embodiment for constituting pole portions, arranged side by side in the shuttling direction, and a second set of yoke pieces 31 for constituting a base portion. The second set 31 is made of a lamination of metal plates each extending in the shuttling direction but laminated together in the line to line direction.

The first set of yoke pieces 32 is formed of a material capable of providing highly saturated magnetic flux density such as Permendur. On the other hand, the second set 31 of the yoke pieces is formed of a material which provides low saturation of magnetic flux density such as silicon steel. From 7 to 14 pieces of the second yoke pieces 31 are used, and thickness of each second yoke piece 31 is in a range of from 0.5 to 1 mm. These are laminated in the line to line direction by caulking or welding to provide the base portion. Further, grooves 31*a* are formed at one side (front side when viewing from printing hammer) of the second yoke pieces 31 at a predetermined pitch for fixedly inserting the ends of the first set of yoke pieces 32 by brazing or welding. Of course, the grooves are aligned with one another when laminating together the second set of yoke pieces 32 in the line to line direction. Furthermore, holes 31*b* are formed in the second set of yoke pieces 31 for fixing the comb yoke block 30 to a portion of the hammer bank assembly.

With this structure, base portion can be easily provided by laminating together the second set of the yoke pieces 31. Moreover, dimensional inaccuracy with respect to the pitch of the pole portions is avoidable (This dimensional inaccuracy may occur in the first embodiment due to the accumulated tolerance as per the thickness of the yoke pieces 21 and 22, since these are all arrayed in the shutting direction). Therefore, in the second embodiment, high dimensional accuracy is obtainable which is capable of providing high accuracy alignment between the printing hammers and corresponding pole portions. Furthermore, in the second embodiment, since the first set of yoke pieces which serve as pole portions do not extend to a rear side (when viewing from the printing hammer) of the base portion of the comb yoke block, necessary amount of the high magnetic flux density material, which is expensive, can be reduced, to thereby reduce production cost of the comb yoke block 30, to thus provide the resultant comb yoke at low cost.

In summary, in the present invention, a part of the comb yoke, i.e, the base portion thereof can be made of a low cost material, so that entire production cost can be lowered. Further, since the base end portion is provided by the laminating arrangement, electrical power consumption for driving the printing hammers and heat generation amount at the hammer bank can be reduced. Consequently, resultant dot line printer is available for high speed printing at low cost.

While the invention has been described in detail and with reference to specific embodiment thereof, it would be apparent to those skilled in the art that various changes and modifications may be made therein without departing from the spirit and scope of the invention.

What is claimed is:

1. A hammer bank assembly of a dot line printer for providing dot impression images on a printing sheet during reciprocal movement of the hammer bank assembly, the printing sheet being fed in a line to line direction, the hammer bank assembly comprising:

a hammer base reciprocally movable in a shuttling direction, the hammer base having a front face;

a plurality of leaf spring type printing hammers held on the front face of the hammer base and arranged side by side at a predetermined pitch in the shuttling direction, the printing hammers having front faces in confrontation with the printing sheet, and having rear faces;

permanent magnets mounted on the hammer base for attracting the printing hammers away from the printing sheet;

a comb yoke mounted on the hammer base, the comb yoke having a base portion positioned on the permanent magnets and pole portions secured by the base portion and extending from the base portion toward the rear faces of the printing hammers, the rear faces of the printing hammers being attracted toward the pole portions by the permanent magnets, the pole portions being made of a first material having a first, highly saturated magnetic flux density, and the base portion comprising a plurality of metal plates laminated together and containing a second material having a second, lower saturated magnetic flux density; and electromagnetic coils wound over the pole portions for releasing the attracted printing hammers from the pole portions for creating dot impressions, wherein the comb yoke comprises first yoke pieces and second yoke pieces alternately arranged side by side in the shuttling direction in a laminating fashion, the second yoke pieces constituting the pole portions and the alternate first and second yoke pieces laminated together constituting the base portion.

2. The hammer bank assembly as claimed in claim 1, wherein the second yoke pieces are longer than the first yoke pieces.

3. The hammer bank assembly as claimed in claim 1, wherein the first yoke pieces are made of the second material and the second yoke pieces are made of the first material.

4. The hammer bank assembly as claimed in claim 3, wherein the first material of the pole portions comprises Permendur.

5. The hammer bank assembly as claimed in claim 3, wherein the second material of the base portion is selected from the group consisting of silicon steel and pure iron.

6. A hammer bank assembly of a dot line printer for providing dot impression images on a printing sheet during reciprocal movement of the hammer bank assembly, the printing sheet being fed in a line to line direction, the hammer bank assembly comprising:

a hammer base provided reciprocally movable in a shuttling direction, the hammer base having a front face;

a plurality of leaf spring type printing hammers held on the front face of the hammer base and arranged side by side at a predetermined pitch in the shuttling direction, the printing hammers having front faces in confrontation with the printing sheet and rear faces;

permanent magnets mounted on the hammer base for attracting the printing hammers away from the printing sheet;

a comb yoke mounted on the hammer base, the comb yoke having a base portion positioned on the permanent magnets and pole portions secured by the base portion and extending from the base portion toward the rear faces of the printing hammers, the rear faces of the printing hammers being attracted toward the pole portions by the permanent magnets, the pole portions being made of a first material having a first, highly saturated magnetic flux density, and the base portion comprising a plurality of metal plates laminated together and containing a second material having a second, lower saturated magnetic flux density; and electromagnetic coils wound over the pole portions for releasing the attracted printing hammers from the pole portions for dot impressions, wherein the comb yoke comprises a plurality of comb yoke blocks arranged side by side in the shuttling direction, each of the comb yoke blocks comprising first yoke pieces and second yoke pieces alternately arranged side by side in the shuttling direction in a laminating fashion, the second yoke pieces constituting the pole portions and the alternate first and second yoke pieces laminated together constituting the base portion.

7. The hammer bank assembly as claimed in claim 6, wherein each of the comb yoke blocks further comprises single third yoke piece positioned at one end of the comb yoke block and made of the second material, a thickness of the third yoke piece being smaller than that of the first comb yoke pieces.

8. The hammer bank assembly as claimed in claim 7, wherein the first material of the pole portions comprises Permendur.

9. The hammer bank assembly as claimed in claim 7, wherein the second material of the base portion is selected from the group consisting of silicon steel and pure iron.

10. A hammer bank assembly of a dot line printer for providing dot impression images on a printing sheet during reciprocal movement of the hammer bank assembly, the printing sheet being fed in a line to line direction, the hammer bank assembly comprising:

a hammer base reciprocally movable in a shuttling direction, the hammer base having a front face;

a plurality of leaf spring type printing hammers held on the front face of the hammer base and arranged side by side at a predetermined pitch in the shuttling direction, the printing hammers having front faces in confrontation with the printing sheet, and having rear faces;

permanent magnets mounted on the hammer base for attracting the printing hammers away from the printing sheet;

a comb yoke mounted on the hammer base, the comb yoke having a base portion positioned on the permanent magnets and pole portions secured by the base portion and extending from the base portion toward the rear faces of the printing hammers, the rear faces of the printing hammers being attracted toward the pole portions by the permanent magnets, the pole portions being made of a first material having a first, highly saturated magnetic flux density, and the base portion comprising a plurality of metal plates laminated together and containing a second material having a second, lower saturated magnetic flux density; and electromagnetic coils wound over the pole portions for releasing the attracted printing hammers from the pole portions for creating dot impressions, wherein the comb yoke comprises a plurality of pole pieces made of the first material and a plurality of base plate pieces made of the second material, the base plate pieces extending in the shuttling direction and laminated together in the line to line direction, one end of the pole pieces being secured to the laminated base plate pieces.

11. The hammer bank assembly as claimed in claim 10, wherein the laminated base plate pieces are formed of a plurality of grooves at a predetermined pitch for fixedly inserting the one end of the pole pieces.

12. The hammer bank assembly as claimed in claim 10, wherein the first material of the pole portions comprises Permendur.

13. The hammer bank assembly as claimed in claim 10, wherein the second material of the base portion is selected from the group consisting of silicon steel and pure iron.

14. A hammer bank assembly of a dot line printer for providing dot impression images on a printing sheet during reciprocal movement of the hammer bank assembly, the printing sheet being fed in a line to line direction, the hammer bank assembly comprising:

a hammer base provided reciprocally movable in a shuttling direction, the hammer base having a front face;

a plurality of leaf spring type printing hammers held on the front face of the hammer base and arranged side by side at a predetermined pitch in the shuttling direction, the printing hammers having front faces in confrontation with the printing sheet and rear faces;

permanent magnets mounted on the hammer base for attracting the printing hammers away from the printing sheet;

a comb yoke mounted on the hammer base, the comb yoke having a base portion positioned on the permanent magnets and pole portions secured by the base portion and extending from the base portion toward the rear faces of the printing hammers, the rear faces of the printing hammers being attracted toward the pole portions by the permanent magnets, the pole portions being made of a first material having a first, highly saturated magnetic flux density, and the base portion comprising a plurality of metal plates laminated together and containing a second material having a second, lower saturated magnetic flux density; and electromagnetic coils wound over the pole portions for releasing the attracted printing hammers from the pole portions for dot impressions, wherein the comb yoke comprises a plurality of comb yoke blocks arranged side by side in the shuttling direction, each of the comb yoke blocks comprising a plurality of pole pieces made of the first material and a plurality of base plate pieces made of the second material, the base plate pieces extending in the shuttling direction and laminated together in the line to line direction, one end of the pole pieces being secured to the laminated base plate pieces.

15. The hammer bank assembly as claimed in claim 14, wherein the first material of the pole portions comprises Permendur.

16. The hammer bank assembly as claimed in claim 14, wherein the second material of the base portion is selected from the group consisting of silicon steel and pure iron.

* * * * *